US010295193B2

(12) United States Patent
Gambardella et al.

(10) Patent No.: US 10,295,193 B2
(45) Date of Patent: May 21, 2019

(54) COOKING APPLIANCE, IN PARTICULAR FOR DOMESTIC USE

(71) Applicant: Whirlpool EMEA S.p.A., Pero (MI) (IT)

(72) Inventors: Fabio Gambardella, Catanzaro Lido (IT); Matteo Scoponi, Civitanova Marche (IT)

(73) Assignee: Whirlpool EMEA S.p.A., Pero (MI) (IT)

( * ) Notice: Subject to any disclaimer, the term of this patent is extended or adjusted under 35 U.S.C. 154(b) by 17 days.

(21) Appl. No.: 15/300,969

(22) PCT Filed: Apr. 1, 2015

(86) PCT No.: PCT/IB2015/052390

§ 371 (c)(1),
(2) Date: Sep. 30, 2016

(87) PCT Pub. No.: WO2015/151041

PCT Pub. Date: Oct. 8, 2015

(65) Prior Publication Data

US 2017/0030586 A1 Feb. 2, 2017

(30) Foreign Application Priority Data

Apr. 3, 2014 (IT) ..... TO2014U0054 U

(51) Int. Cl.
*F24C 15/16* (2006.01)
*F24C 15/00* (2006.01)

(52) U.S. Cl.
CPC ..... *F24C 15/008* (2013.01); *F24C 15/16* (2013.01)

(58) Field of Classification Search
CPC ..... F24C 15/00; F24C 15/16; A21B 1/00
(Continued)

(56) References Cited

U.S. PATENT DOCUMENTS 2,688,688 A * 9/1954 Holtz ..... B60Q 1/2615 362/425
4,255,450 A * 3/1981 Tesmann ..... A01N 37/44 514/626

(Continued)

FOREIGN PATENT DOCUMENTS

EP 0978698 A2 2/2000
EP 2128526 A1 12/2009

(Continued)

*Primary Examiner* — Gregory L Huson
*Assistant Examiner* — Nikhil P Mashruwala
(74) *Attorney, Agent, or Firm* — Price Heneveld LLP

(57) ABSTRACT

The present invention relates to a cooking appliance, in particular for household use, comprising:

at least one cooking compartment cooking foodstuffs, said at least one cooking compartment being obtained in a muffle the cooking appliance and being delimited by a bottom wall, a back wall, a top wall, a first side wall and a second side wall of said muffle;

at least one lighting device associated with said muffle to allow illuminating the cooking compartment;

The invention is characterized in that said at least one lighting device is positioned substantially in proximity to a front frame of the muffle and in correspondence with a first upper corner of said muffle, said at least one lighting device being associated with said muffle in a manner such as to generate a light beam having an axis substantially directed towards a central portion of said at least one cooking compartment.

19 Claims, 4 Drawing Sheets

(58) Field of Classification Search
USPC ..... 126/19 R, 190, 200; 219/391
See application file for complete search history.

(56) References Cited

U.S. PATENT DOCUMENTS

| | | | | |
|---|---|---|---|---|
| 6,361,181 | B1 * | 3/2002 | Bales | F24C 15/008 126/198 |
| 7,157,667 | B2 * | 1/2007 | Gramlich | F24C 15/008 126/190 |
| 8,277,065 | B2 * | 10/2012 | Camarillo Fernandez | F24C 15/02 362/311.01 |
| 2008/0190300 | A1 * | 8/2008 | Adamski | A21B 1/22 99/341 |
| 2012/0167865 | A1 * | 7/2012 | Winkelmann | F24C 15/08 126/19 R |
| 2014/0061188 | A1 * | 3/2014 | Liu | H05B 6/6444 219/679 |

FOREIGN PATENT DOCUMENTS

| | | | |
|---|---|---|---|
| EP | 2128527 | A1 | 12/2009 |
| EP | 2257744 | A1 | 12/2010 |
| EP | 2302304 | A1 | 3/2011 |
| JP | H0526454 | A | 2/1993 |

* cited by examiner

COOKING APPLIANCE, IN PARTICULAR FOR DOMESTIC USE

FIELD OF THE INVENTION

The present invention relates to a cooking appliance, in particular for household use, according to the preamble of claim 1.

BACKGROUND

Cooking appliances, in particular for household use (such as, for example, an oven or a cooking range, wherein "cooking range" refers to a household appliance comprising at least one oven and at least one cooking top), are usually provided with a cooking compartment for cooking foodstuffs, said cooking compartment being obtained in a muffle of the cooking appliance and being delimited by a bottom wall, a back wall, a top wall, and side walls of said muffle.

In addition, known muffles comprise an opening that puts the cooking compartment in communication with the outside environment in order to allow a user to place foodstuffs inside the cooking compartment.

Said opening can be closed with a door, which usually comprises a perimetric frame and supports a suitable thermal glass allowing the user to observe the cooking compartment and any foodstuffs being cooked; also, the door is horizontally pivoted to the oven muffle by means of hinges, which support it and guide its motion as it opens and closes the cooking compartment.

The cooking appliances known in the art are fitted with a lighting device which allows illuminating the cooking compartment and any foods being cooked; said lighting device usually consists of a lamp associated with one of the muffle walls, in particular a back wall of said muffle.

It has however been noticed that such a solution does not provide homogeneous and sufficient illumination throughout the cooking compartment, in particular when foodstuffs to be cooked are present inside the muffle. In fact, in such situations the foodstuffs interfere with the light beam of the lighting device, and create a grey area between the foodstuffs being cooked and the front portion of the muffle.

As a consequence, the above-described solution does not ensure adequate illumination of that portion of the foodstuff being cooked which faces towards the door and the user.

Besides, this problem is even more felt when the cooking compartment is subdivided into a plurality of rack levels. It is in fact known in the art to insert into the muffle at least one support element (e.g. a grid, a baking pan, a dripping pan), the side portions of which are usually associated with the side walls of the muffle; said support elements can be positioned at different heights in the cooking compartment, so that foods can be cooked on multiple levels. It is also clear that such support elements interfere with the light beam of the lighting device associated with a back wall of said muffle, and create a grey area between their body and the front portion of the muffle, thus not allowing proper illumination of that portion of the cooking compartment which faces towards the door and the user.

A cooking appliance (e.g. the one shown in U.S. Pat. No. 7,252,402) is also known in the art which comprises a cooking compartment lighting system associated with a door, said door being horizontally pivoted to a muffle to allow access to the cooking compartment.

While it allows illuminating the portion of the foodstuff being cooked that faces towards the door and the user, it has been noticed that also this system has some drawbacks, since it can only provide illumination of the cooking compartment (and of any element to be cooked placed therein) when the horizontally-pivoted door is in a condition in which it closes the cooking compartment.

SUMMARY OF THE INVENTION

In this frame, it is the main object of the present invention to overcome the above-mentioned drawbacks by providing a cooking appliance, in particular for household use, comprising a lighting device that ensures homogeneous and optimal illumination of the entire cooking compartment of said cooking appliance, in particular for household use.

It is the main object of the present invention to provide a cooking appliance, in particular for household use, comprising a lighting device that ensures homogeneous and optimal illumination of the cooking compartment, particularly when inside said cooking compartment there are foodstuffs to be cooked and/or at least one support element adapted to allow cooking said foodstuffs on multiple levels.

It is another object of the present invention to provide a cooking appliance, in particular for household use, comprising a lighting device that ensures adequate illumination of that portion of the foodstuff to be cooked which faces towards the user.

It is a further object of the present invention to provide a cooking appliance, in particular for household use, comprising a lighting device that ensures adequate illumination of the cooking compartment of the cooking appliance, in particular independently of the open or closed condition of the door horizontally pivoted to a muffle of said cooking appliance.

BRIEF DESCRIPTION OF THE DRAWINGS

Said objects are achieved by the present invention through a cooking appliance, in particular for household use, incorporating the features set out in the appended claims, which are intended to be an integral part of the present description.

Further objects, features and advantages of the present invention will become apparent from the following detailed description and from the annexed drawings, which are supplied by way of non-limiting example, wherein.

DETAILED DESCRIPTION OF THE EMBODIMENTS

Figure 1:
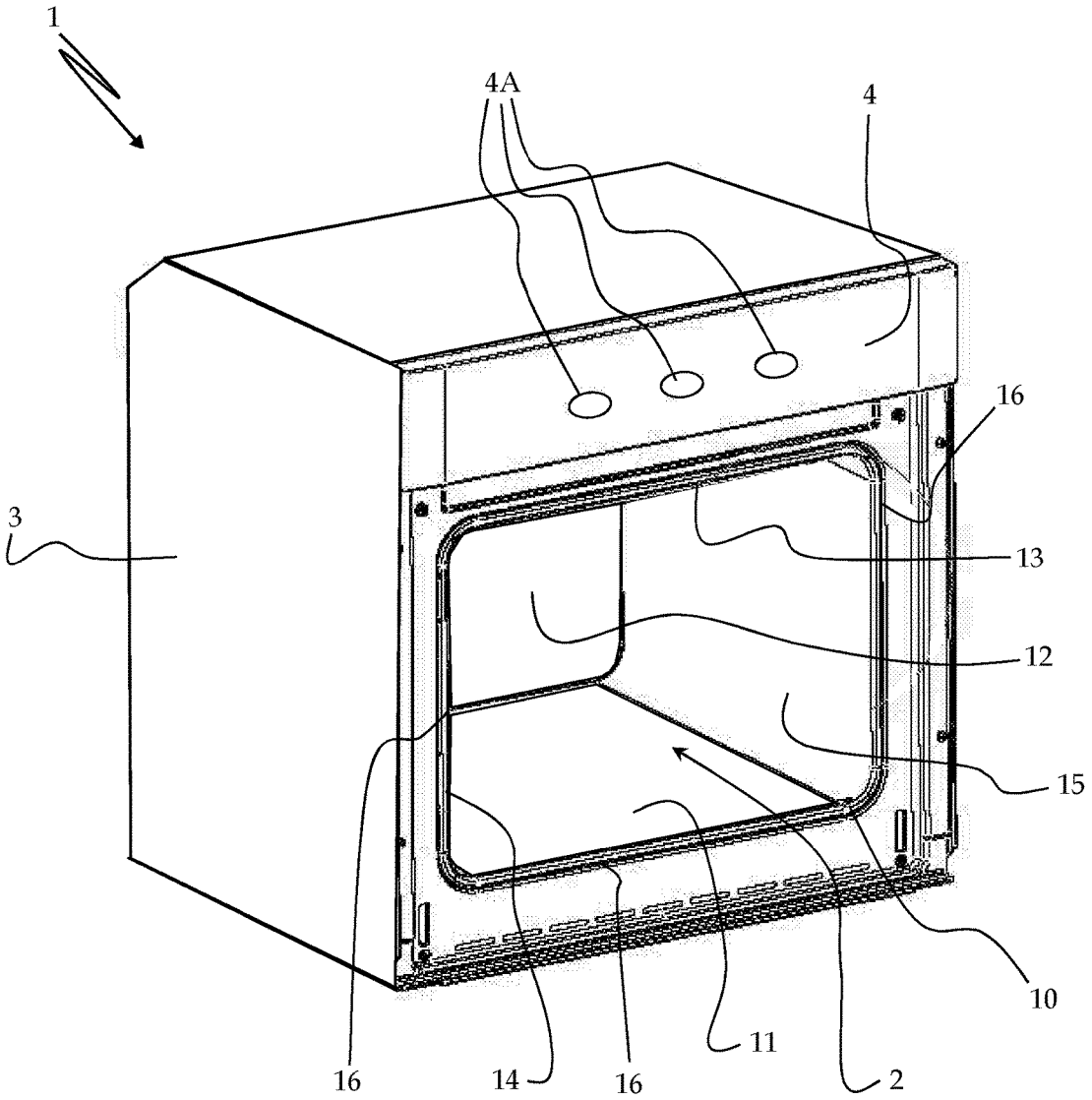
FIG. 1 is a perspective view of a cooking appliance, in particular for household use, according to the present invention.

Referring now to FIG. 1, reference numeral 1 schematically designates as a whole a cooking appliance, in particular for household use, according to the present invention.

Said cooking appliance 1 comprises at least one cooking compartment 2 for cooking foodstuffs, said cooking compartment 2 being obtained in a muffle 10 of the cooking appliance 1 and being delimited by a bottom wall 11, a back wall 12, a top wall 13, a first side wall 14 and a second side wall 15 of said muffle 10.

It should be noted that the bottom wall 11 and the top wall 13 are substantially opposite to each other, just like the first side wall 14 and the second side wall 15.

For the purpose of providing a clearer view of the cooking compartment 2, FIG. 1 does not show a door of the cooking appliance 1, which is preferably horizontally pivoted to the muffle 10 through hinges (not shown) that support it and guide it in its motion as it opens and closes the cooking compartment 2.

FIG. 1 also shows that the cooking compartment 1 according to the present invention preferably comprises:

a casing or cabinet 3 adapted to contain the muffle 10;

a front panel 4, in particular comprising interface means 4A for displaying and/or setting information about the operation of the cooking appliance 1.

Preferably, said front panel 4 is positioned on top of the muffle 10, so that the user can comfortably gain access to said interface means 4A while using the cooking appliance 1.

The cooking appliance 1 according to the present invention preferably comprises at least one support element 5 for dividing the cooking compartment 2 into a plurality of shelves and cooking foodstuffs on multiple levels, in particular by inserting one or more of said support elements 5 into suitable supports 5A (shown in simplified form in FIG. 2), which allow said support element 5 to be positioned at different levels of said first side wall 14 and second side wall 15. By way of example, FIGS. 2 to 3*b* show a grid that represents said at least one support element 5; it is however clear that said at least one support element 5 may also consist of a baking pan or a dripping pan (not shown in the annexed drawings).

Figure 2:
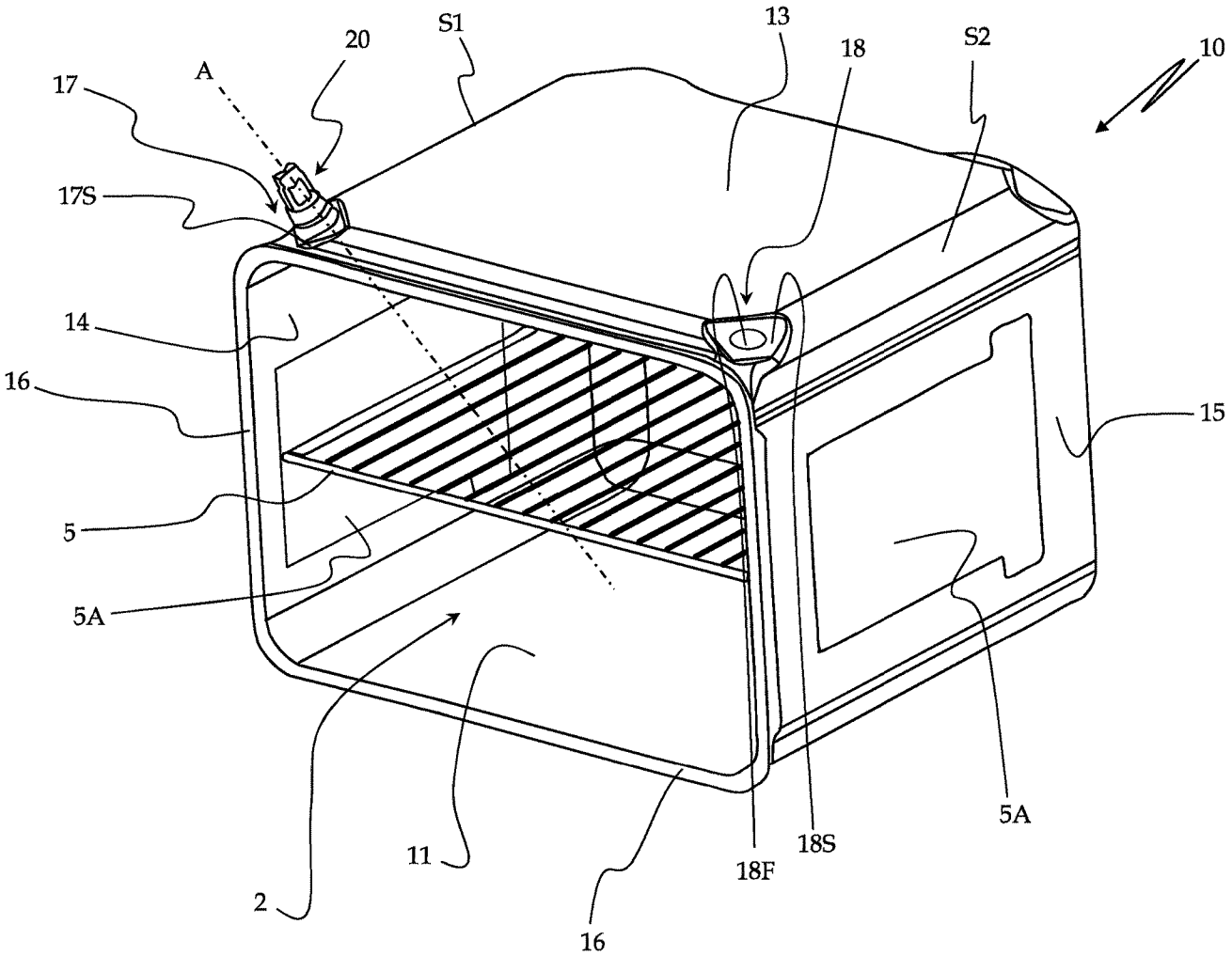
FIG. 2 is a perspective view of a muffle of the cooking appliance according to the present invention.
Figure 3A:
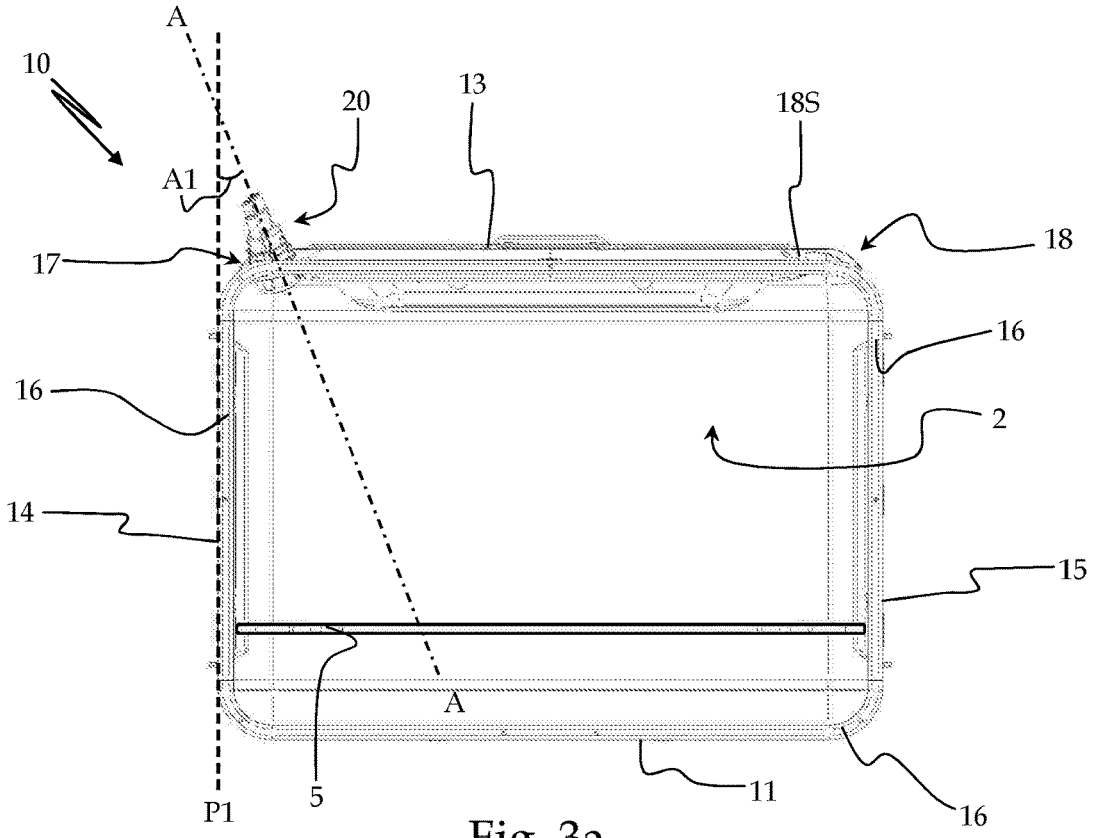
FIGS. 3*a* and 3*b* are, respectively, a front view and a sectional side view of the muffle of the cooking appliance according to the present invention.
Figure 3B:
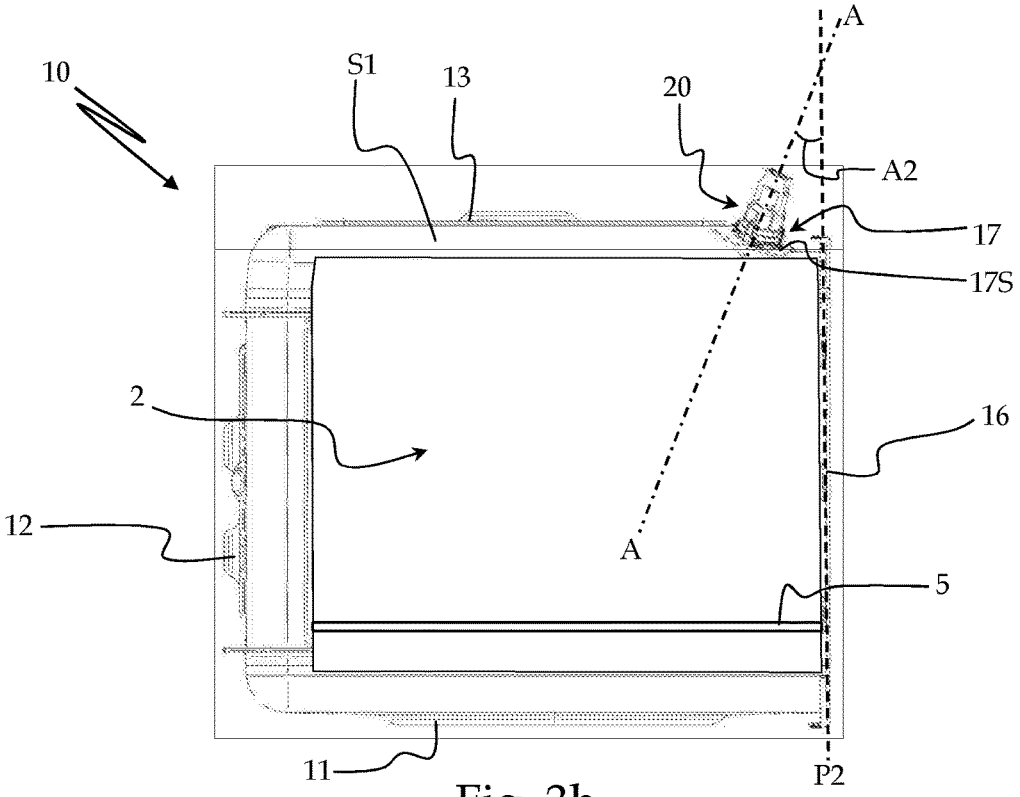
Figure 4:
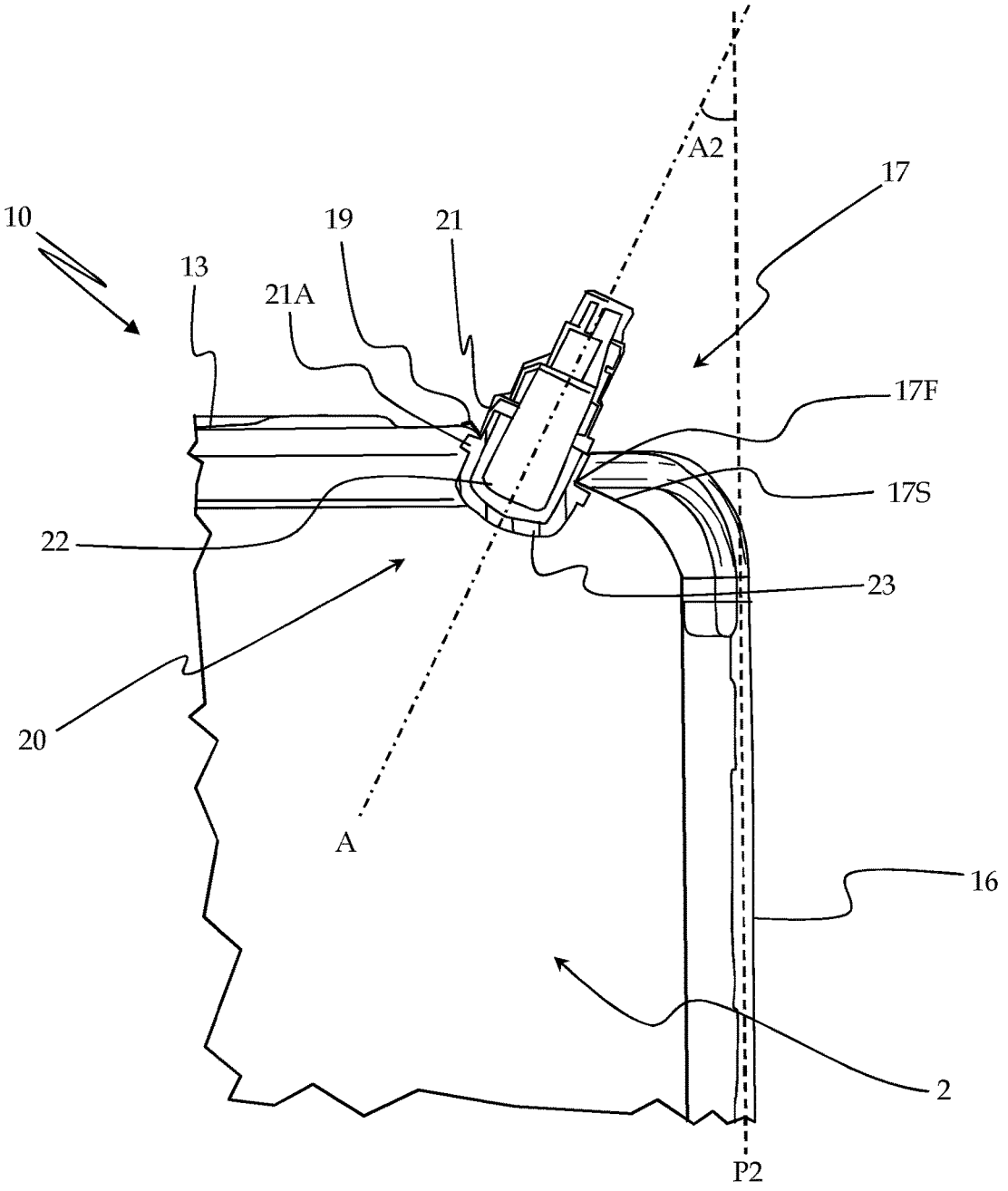
FIG. 4 is a sectional view of a portion of the muffle of the cooking appliance according to the present invention.

Referring now to FIGS. 2 to 4, it can be noticed that the cooking appliance 1 comprises at least one lighting device (designated as a whole by reference numeral 20) associated with said muffle 10 to allow illuminating the cooking compartment 2.

In accordance with the present invention, said at least one lighting device 20 is positioned substantially in proximity to a front frame 16 of the muffle 10 and in correspondence with a first upper corner 17 of said muffle 10, said at least one lighting device 20 being associated with said muffle 10 in a manner such as to generate a light beam having an axis A (drawn with a dashed-dotted line in FIGS. 2 to 4) substantially directed towards a central portion of said at least one cooking compartment 2.

In substance, said front frame 16 of the muffle 10 delimits an opening of the muffle 10, in particular said opening being opposite to the back wall 12 of the muffle 10; as known in the art, the opening of the muffle 10 allows the user to place foodstuffs into the cooking compartment 2 for cooking them.

Also, said first upper corner 17 corresponds to a corner of the muffle 10 located between the top wall 13, the first side wall 14 and the front frame 16.

Consequently, as can be noticed, the front frame 16 substantially corresponds to that part of the muffle 10 which is closest to the door (not shown in the drawings) of the cooking appliance 1; also, the "central portion" of the cooking compartment 2 refers to the intermediate portion of said cooking compartment 2, i.e. a portion substantially equidistant from the door, the bottom wall 11, the back wall 12, the top wall 13 and the first and second side walls 14,15 of the muffle 10.

As is particularly visible in FIGS. 3*a* to 4, the lighting device 20 is associated with said muffle 10 in an inclined manner.

In particular, said lighting device 20 is associated with the muffle 10 in such a way that its axis substantially coincides with said axis A of the light beam, and in such a way that:

a first angle A1 (shown in FIG. 3*a*) is formed between said axis A and a first plane P1 in which the first side wall 14 lies;

a second angle A2 (shown in FIGS. 3*b* and 4) is formed between said axis A and a second plane P2 in which said front frame 16 lies.

It must be pointed out that FIGS. 3*a* to 4 only show the axis A of the light beam, in that it substantially coincides with the axis of the lighting device 20. Also, it clearly emerges from said Figures that said first angle A1 and second angle A2 are the angles formed by the axis A with the first plane P1 and with the second plane P2 towards the cooking compartment 2.

In a preferred embodiment, said first angle A1 is between 15° and 45°, and said second angle A2 is between 15° and 45°.

The peculiar provisions of the present invention allow providing a cooking appliance 1, in particular for household use, comprising a lighting device 20 that ensures homogeneous and optimal illumination of the entire cooking compartment 2 of said cooking appliance 1, particularly when inside said cooking compartment 2 there are foodstuffs to be cooked and/or at least one support element 5 adapted to allow cooking said foodstuffs on multiple levels.

In fact, unlike prior-art cooking appliances, the lighting device 20 has been so conceived as to adequately illuminate that portion of the food to be cooked which faces towards the door and the user, in particular without creating any grey areas between the food to be cooked and the front portion of the muffle 10.

Furthermore, the peculiar provisions of the present invention ensure adequate illumination of the cooking compartment 2 of the cooking appliance 1, in particular independently of the open or closed condition of the door horizontally pivoted to the muffle 10.

It should also be noted that the peculiar position of at least one lighting device 20 according to the present invention, while ensuring illumination of the cooking compartment 2 at an optimal angle, is not in the way of any mechanisms associated with the horizontally-pivoted door for opening and/or closing the latter.

In addition, the position of the lighting device 20 substantially in proximity to a front frame 16 of the muffle 10 facilitates the connection of said lighting device 20 to an electronic board (not shown in the drawings) associated with the front panel 4 of the cooking appliance 1, thus making such operations less costly. In fact, thanks to the provisions of the present invention, the connections between the wire harness of the lighting device 20 and the front panel 4 are simpler. Moreover, the same wire harness is shorter than in prior-art solutions, in which the lighting devices are located in a remote position (being usually associated with a back wall of the muffle) with respect to the control board of the cooking appliance.

According to the present invention, the first upper corner 17 of the muffle 10 is so realized as to comprise a first surface 17S which is substantially flat (shown in FIGS. 2 and 3*b*) and which has a first hole 17F (shown in FIG. 4) to allow accommodating said lighting device 20.

Preferably, said substantially flat first surface 17S consists of a chamfer of a first edge S1 (visible in FIG. 2) formed by the union of the top wall 13 and the first side wall 14.

According to a further embodiment, the cooking appliance 1 comprises a second lighting device 20 (not shown in the drawings), which is positioned substantially in proximity to a front frame 16 of the muffle 10 and in correspondence with a second upper corner 18 of said muffle 10, said second lighting device 20 being associated with said muffle 10 in a manner such as to generate a light beam having an axis (not shown in the drawings) substantially directed towards a central portion of said at least one cooking compartment 2.

In particular, said second upper corner 18 corresponds to a corner of the muffle 10 between the top wall 13, the second side wall 15 and the front frame 16.

Preferably, also the second lighting device 20 is associated with said muffle 10 in an inclined manner, in a way substantially similar to that described with reference to the lighting device 20 associated with the first upper corner 17 of the muffle 10 (i.e. in such a way as to form an angle, corresponding to the first angle A1, with a plane in which the second side wall 15 lies, and another angle, corresponding to the second angle A2, with the plane P2).

In addition, the second upper corner 18 of the muffle 10 is so realized as to comprise a second surface 18S which is substantially flat (shown in FIGS. 2 and 3*a*) and which has a second hole 18F (shown in FIG. 2) to allow accommodating said second lighting device 20.

Preferably, said substantially flat second surface 18S consists of a chamfer of a second edge S2 (also visible in FIG. 2) formed by the union of the top wall 13 and the second side wall 15.

The provision of the second lighting device 20 positioned substantially in proximity to the front frame 16 at a second upper corner 18 of said muffle 10 allows illuminating the cooking compartment 2 in an even more complete and diffused manner. In fact, in accordance with this embodiment, the foodstuffs positioned in the cooking compartment 2 can be illuminated from two different directions by light beams coming at different angles from a front portion (the one near the front frame 16) of the muffle 10; as a result, said illumination clearly eliminates any grey areas on the foodstuffs being cooked, thus allowing optimal vision of the cooking compartment 2 and of any foods placed therein by a user.

With particular reference to FIG. 4, it can be noticed that said at least one lighting device 20 comprises:

- a body 21 adapted to be associated with a substantially flat first surface 17S of the first upper corner 17 and/or with a substantially flat second surface 18S of the second upper corner 18;
- a light source 22 associated with said body 21.

Preferably, the body 21 and the muffle 10 comprise mutual coupling means 19, 21A allowing said lighting device 20 to be connected to the muffle 10; in particular, said mutual coupling means comprise at least one flexible tang 19 associated with the muffle 10 and adapted to cooperate with a step 21A on the body 21, so as to effect a snap-type coupling between the lighting device 20 and the muffle 10.

In particular, with reference to the lighting device 20 positioned at the first upper corner 17, the lighting device 20 is associated with the muffle 10 by inserting the body 21 into the first hole 17F, said insertion occurring by means of an outward movement from the inside of the cooking compartment 2. These provisions ensure a quick and easy coupling between the lighting device 20 and the muffle 10, in addition to making the replacement of the lighting device 20, should it be necessary, much easier.

In this regard, it must be pointed out that the same insertion operation can also be carried out for associating a second lighting device 20 (not shown in the drawings) with the second upper corner 18 of the muffle 10.

In a preferred embodiment, the outer surface of the body 21 (when viewed in a section perpendicular to the axis A) and said holes 17F, 18F have a substantially circular shape. As a consequence, the coupling between the body 21 of the lighting device 20 and said holes 17F, 18F occurs on a substantially circular surface; this ensures a firm and accurate mating of said elements, thereby improving the coupling thereof.

The lighting device 20 according to the present invention further comprises a cover 23 made of transparent or translucent material (preferably glass) adapted to substantially surround said light source 22, in particular for protecting it and for optimally diffusing the generated light. Preferably, the cover 23 is associated with the body 21 and/or with the muffle 10 via a screw connection.

The advantages of a cooking appliance, in particular for household use, according to the present invention are apparent from the above description.

In particular, such advantages consist of the fact that the cooking appliance 1 according to the present invention comprises at least one lighting device 20 that ensures homogeneous and optimal illumination of the entire cooking compartment 2 of said cooking appliance 1, particularly when inside said cooking compartment 2 there are foodstuffs to be cooked and/or at least one support element 5 adapted to allow cooking said foodstuffs on multiple levels.

In fact, unlike prior-art cooking appliances, the lighting device 20 has been so conceived as to adequately illuminate that portion of the food to be cooked which faces towards the door and the user, in particular without creating any grey areas between the food to be cooked and the front portion of the muffle 10.

Another advantage of the cooking appliance 1 according to the present invention is that it has been so conceived as to adequately illuminate the cooking compartment 2 of the cooking appliance 1, in particular independently of the open or closed condition of a door horizontally pivoted to the muffle 10.

It should also be noted that the peculiar position of at least one lighting device 20 according to the present invention, while ensuring illumination of the cooking compartment 2 at an optimal angle, is not in the way of any mechanisms associated with the horizontally-pivoted door for opening and/or closing the latter.

In addition, the position of the lighting device 20 substantially in proximity to a front frame 16 of the muffle 10 facilitates the connection of said lighting device 20 to an electronic board (not shown in the drawings) associated with the front panel 4 of the cooking appliance 1, thus making such operations less costly.

The possible provision of a second lighting device 20 positioned substantially in proximity to the front frame 16 and in correspondence with a second upper corner 18 of said muffle 10 allows illuminating the cooking compartment 2 in an even more complete and diffused manner. In fact, in accordance with such an embodiment, the foodstuffs positioned in the cooking compartment 2 can be illuminated from two different directions by light beams coming at different angles from a front portion of the muffle 10; as a result, said illumination clearly eliminates any grey areas on the foodstuffs being cooked, thus allowing optimal vision thereof by a user.

A further advantage of the cooking appliance 1 according to the present invention is that the provisions of the present invention allow coupling said at least one lighting device 20 to the muffle 10 in a quick, easy, firm and accurate manner, in addition to making the replacement of the lighting device 10, should it be necessary, much easier.

The cooking appliance, in particular for household use, described herein by way of example may be subject to many possible variations without departing from the novelty spirit of the inventive idea; it is also clear that in the practical implementation of the invention the illustrated details may have different shapes or be replaced with other technically equivalent elements.

It can therefore be easily understood that the present invention is not limited to the above-described cooking appliance, in particular for household use, but may be subject to many modifications, improvements or replacements of equivalent parts and elements without departing from the inventive idea, as clearly specified in the following claims.

The invention claimed is:

1. A cooking appliance, in particular for household use, comprising:

at least one cooking compartment for cooking foodstuffs, wherein the cooking compartment is disposed in a muffle of said cooking appliance and being defined by a bottom wall, a back wall, a top wall, a first side wall and a second side wall of the muffle;

at least one lighting device configured to illuminate the cooking compartment, the at least one lighting device being positioned in proximity to a front frame of the muffle and in correspondence with a first upper corner of the muffle, the at least one lighting device being associated with the muffle in a manner such as to generate a light beam having an axis substantially directed towards a central portion of the at least one cooking compartment; and wherein the at least one lighting device includes a step that is removably coupled to a flexible tang of the muffle to effect a snap-type coupling between the lighting device and the muffle.

2. The cooking appliance of claim 1, wherein the front frame defines an opening of the muffle opposite to the back wall of the muffle.

3. The cooking appliance of claim 1, wherein the first upper corner corresponds to a corner of the muffle located between the top wall, the first side wall and the front frame.

4. The cooking appliance of claim 1, wherein the at least one lighting device is associated with the muffle in an inclined manner.

5. The cooking appliance of claim 4, wherein an axis of the lighting device substantially coincides with the axis of the light beam and forms a first angle between the axis of the lighting device and a first plane in which the first side wall is positioned.

6. The cooking appliance of claim 5, wherein an axis of the lighting device substantially coincides with the axis of the light beam and forms a second angle between the axis of the lighting device and a second plane in which the said front frame is positioned.

7. The cooking appliance of claim 6, wherein the first angle and the second angle are between 15° and 45°.

8. The cooking appliance of claim 1, wherein the first upper corner of the muffle includes a first surface which is substantially flat and which defines a first hole for accommodating the lighting device.

9. The cooking appliance of claim 1, wherein said cooking appliance includes a second lighting device positioned in proximity to the front frame of the muffle and in correspondence with a second upper corner of the muffle, wherein the second lighting device generates a light beam having an axis substantially directed towards the central portion of the at least one cooking compartment.

10. The cooking appliance of claim 9, wherein the second upper corner corresponds to a corner of the muffle located between the top wall, the second side wall, and the front frame.

11. The cooking appliance of claim 9, wherein the second lighting device is associated with the muffle in an inclined manner.

12. The cooking appliance of claim 9, wherein the second upper corner of the muffle includes a second surface which is substantially flat and which has a second hole for accommodating the second lighting device.

13. The cooking appliance of claim 1, wherein the at least one lighting device comprises:

a body adapted to be associated with a substantially flat first surface of one of the first upper corner and a second upper corner; and a light source associated with the body.

14. The cooking appliance of claim 13, wherein the at least one lighting device includes a cover made of transparent or translucent material proximate the light source.

15. A cooking appliance comprising:

a muffle defining a cooking compartment, wherein the cooking compartment is defined by a bottom wall, a back wall, a top wall, a first side wall and a second side wall of the muffle;

at least one lighting device configured to illuminate the cooking compartment, the at least one lighting device being positioned in proximity to a front opening of the muffle and in correspondence with a first upper corner of the muffle, the lighting device having an axis substantially directed towards a central portion of a bottom wall of the cooking compartment; and wherein the at least one lighting device is removably coupled to a flexible tang of the muffle.

16. The cooking appliance of claim 15, wherein the opening is defined in a front frame of the muffle.

17. The cooking appliance of claim 15, wherein the first upper corner corresponds to a corner of the muffle located between the top wall, the first side wall, and the front frame.

18. The cooking appliance of claim 15, wherein the first upper corner of the muffle includes a first surface which is substantially flat and which defines a first hole for receiving the lighting device.

19. The cooking appliance of claim 15, wherein the at least one lighting device comprises:

a body, the body being adapted to be associated with a substantially flat first surface of one of the first upper corner and a second upper corner of the muffle; and a light source associated with the body.

* * * * *